US005312688A

United States Patent [19]

Honguu et al.

[11] Patent Number: 5,312,688

[45] Date of Patent: May 17, 1994

[54] ACARICIDE FIBER MATERIAL AND PROCESS FOR PRODUCING SAME

[75] Inventors: Tetsuya Honguu; Mikio Tashiro, both of Matsuyama; Kazunori Orii, Kusatsu, all of Japan

[73] Assignee: Teijin Limited, Osaka, Japan

[21] Appl. No.: 388,703

[22] Filed: Aug. 2, 1989

[30] Foreign Application Priority Data

Aug. 10, 1988 [JP] Japan ..... 63-197878

[51] Int. Cl.[5] ..... A01N 25/34; B05D 1/18; B05D 3/02; B32B 27/34

[52] U.S. Cl. ..... 428/395; 428/372; 428/378; 424/405; 424/403; 424/407; 424/443; 427/430.1; 427/434.6; 427/372.2; 427/384

[58] Field of Search ..... 428/395, 378, 394, 357, 428/290, 907; 424/403, 443, 405, 407; 427/384, 372.2, 430.1, 434.6

[56] References Cited

U.S. PATENT DOCUMENTS

| | | | |
|---|---|---|---|
| 2,307,178 | 1/1943 | Whitehead | 28/74 |
| 3,036,088 | 5/1962 | Harris | 424/403 |
| 3,427,388 | 2/1969 | Scoggin | 424/403 |
| 3,725,540 | 4/1973 | Wahl | 424/46 |
| 3,928,556 | 12/1975 | Sweger | 423/45 |
| 3,959,556 | 5/1976 | Morrison | 428/364 |
| 4,228,124 | 10/1980 | Kashihara et al. | 424/40 |
| 4,649,078 | 3/1987 | McEntee et al. | 428/395 |
| 4,816,261 | 3/1989 | Luebbe et al. | 424/DIG. 5 |

FOREIGN PATENT DOCUMENTS

| | | | |
|---|---|---|---|
| 0177127 | 4/1986 | European Pat. Off. . | |
| 296857 | 12/1988 | European Pat. Off. . | |
| 357957 | 3/1990 | European Pat. Off. . | |
| 574707 | 4/1976 | Fed. Rep. of Germany . | |
| 60-239401 | 11/1985 | Japan . | |
| 102479 | 5/1986 | Japan . | |
| 40025 | 2/1989 | Japan . | |
| 1052886 | 2/1989 | Japan | 424/443 |
| 66103 | 3/1989 | Japan . | |
| 738665 | 10/1955 | United Kingdom . | |

OTHER PUBLICATIONS

Textil Veredlung, vol. 5, No. 4, Apr. 1970.

*Primary Examiner*—Patrick J. Ryan
*Assistant Examiner*—J. M. Gray
*Attorney, Agent, or Firm*—Burgess Ryan & Wayne

[57] ABSTRACT

An acaricide fiber material including a number of individual fibers and an acaricide component fixed to the individual fibers and consisting essentially of a solution comprising at least one member selected from the group consisting of N-(fluorodichloromethylthio)-phthalimide, N-methyl-N,-phenyl-(N'-fluorodichloro-methylthio)-sulfamide, 4-chlorophenyl-3'-iodoproparagyl formal, and 2,4,4'-trichloro-2'-hydroxydiphenyl-ether, dissolved in a carrier consisting of at least one type of phthalic acid ester, prepared by suspending the acaricide solution in an aqueous medium, applying the acaricide aqueous suspension to a fiber material comprising the individual fibers, and drying the aqueous suspension layers on the individual fibers to fix the acaricide component to the individual fibers.

9 Claims, 1 Drawing Sheet

ACARICIDE FIBER MATERIAL AND PROCESS FOR PRODUCING SAME

BACKGROUND OF THE INVENTION

1. Field of the Invention

The present invention relates to an acaricide fiber material and a process for producing same.

More particularly, the present invention relates to an acaricide fiber material having an excellent and durable acaricide effect and a satisfactory processability and practical properties, and a process for producing same at a high efficiency.

2. Description of the Related Art

Usually, a fiber mass to be stuffed in bedquilts is made from cotton fibers, feather fibers, wool fibers, floss (silk) fibers or buckwheat chaffs.

The above-mentioned fiber materials are all natural materials and thus contain small insects or other animalcules which can become verminous under certain conditions.

Currently, synthetic fiber, for example, polyester fibers, which are usually free from small insects or other animalcules, are used as a stuffing or wadding material.

Also, due to the westernization of lifestyles in Japan, the livingrooms and bedrooms of Japanese houses are now closed rooms.

A closed room in Japan will often become hot and very humid or damp, and this heat and humidity in such closed rooms causes an extraordinary propagation of various moulds, bacteria, and zooparasites. Especially, various acarina, for example, acarus scabiei and acaridae, easily propagate in tatami mats, carpets, and bedquilts, under such hot and humid conditions.

Acarina bite the skin of humans to cause not only itching but also infantile asthma. Furthermore, acarina is considered to be a pathogenic organism causing Kawasaki disease.

Accordingly, the extermination of acarina is now very important from a social viewpoint.

In the past, an old type of acaricide, for example, DDT or BHC was used to exterminate acaruses, but due to a high toxicity or harmfulness thereof, the use of DDT or BHC is now prohibited.

Japanese Unexamined Patent Publication (Kokai) No. 60-239401 discloses an acaricide which exhibits a low toxicity and a broad applicability to various types of acaruses and comprises, as an effective component, at least one member selected from the group consisting of N-(fluorodichloromethylthio)phthalimide, N-dimethyl-N'-phenyl-(N'-fluorodichloromethylthio)sulfamide, 4-chlorophenyl-3'-iodopropagyl formal, and 2,4,4'-trichloro-2'-hydroxydiphenyl ether.

It was not known how to firmly fix the acaricide to individual fibers in the fiber material, i.e., even when applied to the fiber material, the acaricide on the individual fibers was easily removed by an external force. Namely, when the fiber material containing the acaricide is processed in a carding step or bedquilt-making step, the acaricide is easily separated and removed from the individual fibers, and accordingly, the final fiber product contains substantially no acaricide, and thus has no acarus-extermination effect.

In another attempt at fixing the acaricide to the fibers, the acaricide material was blended with a fiber forming polymer and the blend converted to synthetic fibers. It was found that the resultant synthetic fibers exhibited an unsatisfactory modulus of elasticity, bulkiness, and elastic recovery, in comparison with those of corresponding ordinary fibers. Also, in the acaricide blend fiber, only a portion of the acaricide on the outer surface of the fiber and exposed to the outside is effectively utilized, i.e., the utilization efficiency of the acaricide is very poor.

Under the above-mentioned circumstances, there is a strong demand for the provision of a new method of firmly fixing the acaricide to fiber materials, whereby the fixed acaricide is utilized at a high efficiency.

SUMMARY OF THE INVENTION

An object of the present invention is to provide an acaricide fiber material having an excellent and durable acaricide effect and a satisfactory processability and practical properties, and a process for producing the same at a high efficiency.

The above-mentioned object can be obtained by the acaricide fiber material of the present invention, which comprises a number of individual fibers and acaricide layers fixed to the individual fibers and consisting essentially of a solution comprising an acaricide consisting of at least one member selected from the group consisting of N-(fluorodichloromethylthio)-phthalimide, N-methyl-N'-phenyl-(N'-fluorodichloromethylthio)-sulfamide, 4-chlorophenyl-3'-iodopropagyl formal, and 2,4,4'-trichloro-2'-hydroxydiphenyl-ether and dissolved in a carrier consisting of at least one type of phthalic acid ester in an amount of at least two times the weight of the acaricide.

The acaricide fiber material mentioned above can be produced by the process of the present invention which comprises the steps of:

suspending, in an aqueous medium, a solution of an acaricide comprising at least one member selected from the group consisting of N-(fluorodichloromethylthio)-phthalimide, N-dimethyl-N'-phenyl-(N,-fluorodichloromethylthio)-sulfamide, 4-chlorophenyl-3'-iodoproparagyl formal, and 2,4,4'-trichloro-2'-hydroxydiphenyl-ether, and dissolved in a carrier consisting of at least one type of phthalic acid ester in an amount of at least two times the weight of the acaricide;

applying the aqueous suspension to a fiber material comprising a number of individual fibers to attach the aqueous suspension to the individual fibers; and drying the resultant aqueous suspension-layers in the individual fibers to fix the acaricide dissolved in the carrier to the individual fibers.

DESCRIPTION OF THE PREFERRED EMBODIMENTS

In the acaricide fiber material of the present invention an acaricide in the form of a solution in a carrier is firmly fixed to a number of individual fibers in the fiber material.

The individual fibers usable for the present invention can be selected from natural fibers, for example, cotton fibers, wool fibers, other animal hair fibers, silk fibers, hemp fibers, and ramie fibers; regenerated fibers, for example, viscose rayon fibers and cupra fibers; semisynthetic fibers, for example cellulose triacetate fibers and cellulose diacetate fibers; and synthetic fibers, for example, polyamide (such as nylon 6, and nylon 66) fibers, polyester (such as polyethylene terephthalate) fibers, polyacrylic (such as polyacrylonitrile and modacrylic polymer) fibers; and polyolefin (such as polyethylene and polypropylene) fibers.

Figure 1:
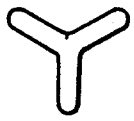
FIGS. 1 to 11, respectively, show cross-sectional profiles of individual fibers usable for the present invention.
Figure 2:
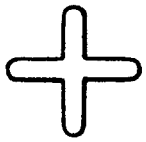
Figure 3:
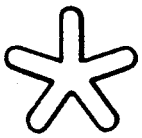
Figure 4:
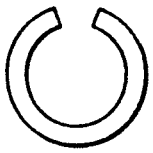
Figure 5:
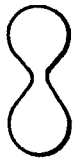
Figure 6:
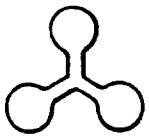
Figure 7:
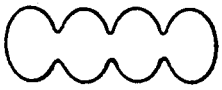
Figure 8:
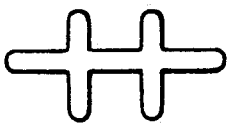
Figure 9:
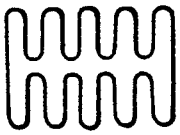
Figure 10:
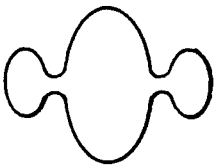
Figure 11:
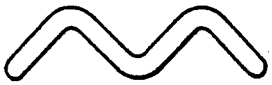

The artificial fibers can be provided with any cross-sectional profile, for example, a regular (circular) cross-section and irregular cross-sections, for example, oval and triangular profiles, especially multilobal cross-sections as indicated in FIG. 1 to 3, other cross-sections having one or more concave portions as indicated in FIGS. 4 to 6, and special flat cross-sections each having a complicated profile as indicated in FIG. 7 to 11.

Preferably, the individual fibers to be used for the present invention are provided with a complicated surface form and thus have a large surface area. Especially, the concave portions in the surfaces of the individual fibers are effective for containing and firmly holding the acaricide therein.

The individual fibers may be hollow fibers.

Also, the individual fibers are preferably provided with a number of fine pores which are formed in at least surface portions thereof and are effective for containing and firmly retaining the acaricide therein.

The acaricide contained in the concavities or fine pores in the surfaces of the individual fibers has a high durability and can gradually exhibit the acaricide effect over a long time.

The individual fibers are not limited to those having a specific thickness. Preferably, the individual fibers to be used for the present invention have a denier of 0.01 to 100, more preferably 1.0 to 30.

The individual fibers may be crimped fibers, and the crimps on the individual fibers can be formed by a stuffing box method or can be cubic crimps formed by a composite spinning method or an asymmetric cooling-spinning method.

The individual fibers can be selected from continuous filaments and cut fibers having a length of preferably 0.3 to 200 mm.

When used as stuffing or wadding fibers, the individual fibers are preferably cut fibers exhibiting a high bulkiness, elastic recovery, and modulus of elasticity and having a length of 10 to 100 mm. The cut fibers preferably consist essentially of a polyester resin, for example, polyethylene terephthalate, polybutylene terephthalate, or a polyethylene-butylene terephthalate copolymer.

The individual fibers having a number of fine pores which are formed in at least the surface portion thereof and may be connected to other pores formed inside of the fibers, can be produced by a known method. For example, a blend of a foaming agent with a fiber-forming polymer material is converted to fibers while the foaming agent is rapidly gasified. Alternatively, pore-forming particles are blended with a fiber-forming polymeric material, the blend is converted to fibers, and the pore-forming particles are removed to leave pores in the fibers.

The individual synthetic fibers usable for the present invention can be produced by the methods disclosed in Japanese Examined Patent Publication Nos. 44-2064, 45-1048, 45-3887, 45-28731, and 47-11,280, and Japanese Unexamined Patent Publication Nos. 56-20612 and 57-11212.

The acaricide fiber material of the present invention may be in any form of fiber materials, for example, fiber mass yarn, fabric, or webs, but preferably the acaricide fiber material is a cut fiber mass usable as a stuffing or wadding fiber material for various quilts and bedquilts.

In the acaricide fiber material of the present invention, the acaricide must consist of at least one member selected from the specific group consisting of N-(fluorodichloromethylthio) phthalimide, N-methyl-N'-phenyl-(N'-fluorodichloromethylthio)sulfamide, 4-chloro-phenyl-3'-iodoproparagyl formal, and 2,4,4'-trichloro-2'-hydroxydiphenyl ether, and must be in the form of a solution in a specific carrier consisting of at least one type phthalic acid ester in an amount of at least two times, preferably, 2.5 to 20 times, the weight of the acaricide.

The above-mentioned specific compounds have a boiling point of about 200° C. and exhibit a satisfactory acaricide effect and durability and substantially no toxicity and harm to the human body. Also, the specific acaricide compounds are insoluble or have a very low solubility in usual volatile organic solvents, for example, aliphatic lower alcohols, ketones, ethers, and hydrocarbons.

When applied to the individual fibers by using a usual solvent, or without using the usual solvent, the acaricide compound is easily separated and removed from the individual fibers.

Accordingly, in the present invention, the specific acaricide is dissolved in a specific carrier consisting essentially of at least one phthalic acid ester.

The phthalic acid ester is preferably selected from liquid alkyl phthalates, for example, dimethyl phthalate (b.p. =282° C.), diethyl phthalate (b.p. =295° C.), dibutyl phthalate (m.p. =−35° C., b.p. =339° C.), and methylethyl phthalate (b.p. =285°-287° C.).

The specific acaricide solution of the present invention can be firmly fixed to the individual fibers and exhibits an excellent and durable acaricide effect.

In the acaricide solution, if the amount of the carrier is less than two times the weight of the acaricide, the carrier cannot completely dissolve the acaricide and thus a portion of the acaricide is deposited outside of the carrier and cannot be firmly fixed to the individual fibers. Therefore, the resultant acaricide fiber material cannot exhibit a satisfactory acaricide effect.

In the acaricide fiber material, the acaricide fixed to the individual fibers is preferably in an amount of 0.02% or more, more preferably from 0.05% to 50%, based on the weight of the individual fibers.

Since the specific acaricide compounds have a boiling point of about 200° C., the acaricide fiber material of the present invention must be practically processed and used at a temperature of 90° C. or less.

When the acaricide fiber material of the present invention is exposed to a high temperature of 100° C. or higher, the acaricide compounds are sometimes heat-decomposed or evaporated.

For example, the application of the acaricide solution to the fiber material must be carried out after the high temperature steps, for example, the drawing step, crimping step, drying step, heat-setting step, and heat treating steps at a temperature of 100° C. to 230° C., are completed.

In the process of the present invention, a solution of the acaricide in the carrier is suspended or dispersed in an aqueous medium. The aqueous medium consists essentially of water or an aqueous solution of an additive, for example, a surfactant, antistatic agent, pigment, flame retarder or perfume, as long as the additive does not affect the durability and the acaricide effect of the resultant acaricide fiber material.

Preferably, in the aqueous suspension, the acaricide is in a concentration of 1.0% to 30%, more preferably 2.0% to 15%, based on the total weight of the aqueous suspension.

The aqueous suspension is applied to the fiber material which comprises a number of individual fibers already passed through the high temperature steps, for example, drawing, crimping, drying, heat-setting, or other processing steps at a temperature of 100° C. or more, by conventional coating operations, for example, spraying, dipping, or oiling roller operations to evenly coat the individual fiber surfaces with the aqueous suspension. When the spraying or oiling roller operation is applied, the fine drops of the aqueous suspension formed on the individual fiber surfaces can spread and diffuse throughout the surfaces and evenly coat the surfaces to the same extent with regard to the resultant acaricide effect as that by the dipping operation.

The spread and diffusion of the aqueous suspension can be promoted by stuffing or arranging the individual fibers to form a number of capillaries among the individual fibers. The oiling roller operation is advantageous in that the aqueous suspension is not scattered into the ambient atmosphere, and thus waste of the expensive acaricide is avoided. Therefore, the utilization efficiency of the acaricide is higher than that in the spraying operation.

The resultant aqueous suspension layers on the individual fiber surfaces are then dried to firmly fix the acaricide dissolved in the carrier to the individual fibers, especially individual polyester fibers.

The drying operation is preferably carried out at a temperature of 10° C. to 90° C., more preferably 15° C. to 50° C., for 3 minutes to 30 hours.

EXAMPLES

The present invention will be further explained by the following examples.

In the examples, the following tests were carried out.

(1) Test for evaluating acaricide effect

A polyethylene film bag having a width of 20 cm and a length of 20 cm was charged with 10 g of acaricide fiber web to be tested and 300 acaridaes. The bag was then sealed and left at a temperature of 25° C. for 24 hours. Thereafter, the acaridaes in the fiber web were observed by a microscope and the number of live acaridaes counted.

In the control, the same procedures as mentioned above were carried out except that the acaricide fiber web was replaced by a non-treated fiber web.

The degree of acaricide effect of the acaricide fiber web was calculated in accordance with the following equation:

$$A\,(\%) = \frac{x - y}{x} \times 100$$

wherein A in % represents a degree of acaricide effect of the acaricide fiber web, x represents the number of live acaridaes in the non-treated fiber web, and y represents the number of live acaridaes in the acaricide fiber web.

(2) The specific volume, compressibility, and compression recovery of the fiber material to be tested were measured in accordance with Japanese Industrial Standard (JIS) L-1097.

EXAMPLE 1

An aqueous suspension was prepared by dispersing a solution of 5 parts by weight of N-(fluorodichloromethylthio)phthalimide (NFP) in 20 parts by weight of diethyl phthalate (DEP) in 75 parts by weight of water.

Separately, a tow having a total thickness of 100,000 denier and consisting of a number of hollow polyethylene terephthalate filaments each having a thickness of 6 denier was drawn at a draw ratio of 3 and at a temperature of 70° C. A solution of sodium salt of cetyl phosphate was applied in an amount of 0.2% by dry solid weight to the drawn filament tow, and the drawn filament tow was then subjected to a crimping operation using a stuffing crimping box at a temperature of 90° C., and heat-set at a temperature of 140° C.

The aqueous suspension was sprayed onto the heat-set filament tow so that the acaricide compound was coated in an amount of 0.1% by weight on the surfaces of the individual filaments in the tow, and the sprayed filament tow was dried at a temperature of 20° C. for 3 hours.

The resultant coated tow was cut to provide acaricide cut fibers having a thickness of 6 denier and a length of 51 mm. The acaricide fibers contained the acaricide compound in an amount of 0.1% based on the weight of the fibers. A mass of the acaricide fibers was then subjected to a carding operation to provide an acaricide fiber web.

The carded acaricide fiber web retained 80% by weight of the acaricide compound applied to the fibers, as shown in Table 1.

The degree of acaricide effect, specific volume, compressibility, and compression recovery of the resultant acaricide fiber web are shown in Table 1.

It was confirmed that the acaricide fiber mass exhibited a satisfactory carding property, acaricide effect, bulkiness, and compression properties.

EXAMPLES 2 TO 7 ANC COMPARATIVE EXAMPLES 1 TO 2

In each of Examples 2 to 7 and Comparative Examples 1 to 2, the same procedures as described in Example 1 were carried out except that the acaricide consisted of the compound indicated in Table 1 and used together with the type of carriers in the amount indicated in Table 1.

The test results are shown in Table 1.

EXAMPLE 8

The same procedures as those described in Example 1 were carried out with the following exceptions.

The aqueous suspension was sprayed onto a polyethylene terephthalate filament tow having a total thickness of 400,000 denier, consisting of a number of hollow individual filaments having a thickness of 6 denier, and provided with a number of fine pores distributed throughout the bodies of the filaments, including surface portions thereof, and connected to each other.

The sprayed filament tow was packed in a bale and kept in this state for about 10 days. Then, the acaricide filament tow was cut to provide cut fibers having a length of 51 mm.

The amount of the acaricide compound fixed to the fibers was 0.1% based on the weight of the fibers.

The acaricide fibers were carded without difficulty, to form a web.

The amount of the acaricide compound retained on the carded individual fibers was about 77%.

The test results are shown in Table 1.

TABLE 1

| Item Example No. | Aqueous acaricide solution: Acaricide compound | Aqueous acaricide solution: Carrier | Composition of acaricide aqueous solution (%): Acaricide | Carrier | Water | Amount of acaricide coated on the fibers (%) |
|---|---|---|---|---|---|---|
| Example 1 | N-(fluorodichloromethylthio) phthalimide (NFP) | Diethyl-phthalate (DEP) | 5 | 20 | 75 | 0.1 |
| Example 2 | N-dimethyl-N'-phenyl-(N'-fluorodichloromethylthio)-sulfamide (NFS) | Diethyl-phthalate (DEP) | 5 | 20 | 75 | 0.1 |
| Example 3 | 4-chlorophenyl-3'-indopropagyl formal (IPH) | Diethyl-phthalate (DEP) | 5 | 20 | 75 | 0.1 |
| Example 4 | 2,4,4'-trichloro-2'-hydroxydi-phenylether (CHPE) | Diethyl-phthalate (DEP) | 5 | 20 | 75 | 0.1 |
| Example 5 | NFP/NFS = 1/1 | Diethyl-phthalate (DEP) | 5 | 20 | 75 | 0.1 |
| Example 6 | NFP/NFS/IPH = 1 = 1 = 1 | Diethyl-phthalate (DEP) | 5 | 20 | 75 | 0.1 |
| Comparative Example 1 | NFP | — | 5 | 0 | 95 | 0.1 |
| Example 7 | NFP | DEP | 5 | 20 | 75 | 0.02 |
| Comparative Example 2 | NFP | " | 5 | 5 | 90 | 0.1 |
| Example 8 | NFP | DEP | 5 | 20 | 75 | 0.1 |

| | Amount of acaricide retained on carded fiber web (%) | Degree of acaricide effect (%) | Specific volume ($cm^3/g$) | Compressibility (%) | Compression recovery (%) |
|---|---|---|---|---|---|
| Example 1 | 80 | 99.5 | 112 | 63 | 97 |
| Example 2 | 82 | 85 | 108 | 64 | 96 |
| Example 3 | 78 | 83 | 109 | 65 | 97 |
| Example 4 | 76 | 80 | 113 | 62 | 98 |
| Example 5 | 75 | 95 | 108 | 63 | 97 |
| Example 6 | 81 | 97 | 111 | 62 | 96 |
| Comparative Example 1 | 5 | 2 | 107 | 64 | 96 |
| Example 7 | 80 | 75 | 109 | 65 | 97 |
| Comparative Example 2 | 32 | 23 | 112 | 63 | 97 |
| Example 8 | 77 | 99 | 105 | 63 | 97 |

As Table 1 clearly shows, the acaricide fiber materials of the present invention exhibit an excellent and durable acaricide effect, fixing property to the individual fibers, and satisfactory compression properties, and thus are useful as stuffing or wadding materials for quilted clothes, bedquilts, sleeping bags, pillows, and stuffed toys, and non-woven fabrics or filter cloths.

We claim:

1. An acaricide fiber material comprising: a number of individual polyester fibers and an acaricide component fixed to the individual fibers, wherein the acaricide component consists essentially of a solution comprising at least one acaricide selected from the group consisting of N-(fluorodichloromethylthio)-phthalimide, N-methyl-N'-pehnyl-(N'fluorodichloromethylthio)-sulfamide, 4-chlorophenyl-3'-iodopropargyl formal, and 2,4,4'-trichloro-2'-hydroxydiphenylether, dissolved in a carrier consisting of diethyl phthalate, said acaricide being fixed to the individual polyester fibers, in an amount of from 0.05% to 5.0% based on the weight of the individual polyester fibers and said diethyl phthalate being present in an amount of 2.5 to 20 times the weight of the acaricide.

2. The acaricide fiber material as claimed in claim 1, wherein the individual fibers have a denier of from 0.01 to 100.

3. The acaricide fiber material as claimed in claim 1, wherein the fiber material is a fiber mass usable for bedquilts.

4. A process for producing an acaricide fiber material, comprising the steps of:

suspending, in an aqueous medium, a solution of an acaricide comprising at least one member selected from the group consisting of N-(fluorodichloromethylthio)-phthalimide, N-dimethyl-N'-phenyl-(N'-fluorodichloromethylthio)-sulfamide, 4-chlorophenyl-3'-iodopropargyl formal, and 2,4,4'-trichloro-2'hydroxydiphenylether, dissolved in a carrier consisting of diethyl phthalate, said diethyl phthalate being present in an amount of 2.5 times to 20 times the weight of the acaride;

applying the aqueous suspension to a fiber material comprising a number of individual polyester fibers to attach the aqueous suspension to the individual polyester fibers to form a wetted fiber material; and drying the wetted fibrous material to fix the acaricide dissolved in the carrier to the individual polyester fibers, said acaricide being fixed to the fibers in an amount of from 0.5% to 5.0%, based on the weight of the individual polyester fibers.

5. The process as claimed in claim 4, wherein the acaricide in the aqueous suspension is in a concentration of 1.0 to 30% based on the total weight of the aqueous suspension.

6. The process as claimed in claim 4, wherein the aqueous medium consists of water.

7. The process as claimed in claim 4, wherein the individual fibers have a denier of from 0.01 to 100.

8. The process as claimed in claim 4 wherein the drying step is carried out at a temperature of from 10° C. to 90° C.

9. The process as claimed in claim 4, wherein the fiber material is a fiber mass usable for bedquilts.

* * * * *